US007722332B2

(12) United States Patent
Lim

(10) Patent No.: US 7,722,332 B2
(45) Date of Patent: May 25, 2010

(54) COMPOSITE DRY VACUUM PUMP HAVING ROOTS ROTOR AND SCREW ROTOR

(75) Inventor: Moon Gi Lim, Chungcheongnam-do (KR)

(73) Assignee: LOT Vacuum Co., Ltd., Chungcheongnam-do (KR)

( * ) Notice: Subject to any disclaimer, the term of this patent is extended or adjusted under 35 U.S.C. 154(b) by 726 days.

(21) Appl. No.: 11/239,722

(22) Filed: Sep. 30, 2005

(65) Prior Publication Data

US 2006/0083651 A1 Apr. 20, 2006

(30) Foreign Application Priority Data

Oct. 1, 2004 (KR) ..... 10-2004-0078422
Oct. 1, 2004 (KR) ..... 10-2004-0078423
Oct. 1, 2004 (KR) ..... 10-2004-0078431

(51) Int. Cl.
*F04B 23/08* (2006.01)

(52) U.S. Cl. ..... 417/205; 417/199.1

(58) Field of Classification Search ..... 417/199.1, 417/205, 423.4
See application file for complete search history.

(56) References Cited

U.S. PATENT DOCUMENTS 3,108,739 A * 10/1963 Schibbye et al. ..... 417/428
3,146,723 A * 9/1964 Wildhaber ..... 417/321
4,762,469 A * 8/1988 Tischer ..... 417/279
4,816,046 A * 3/1989 Maeba et al. ..... 96/221
5,836,754 A * 11/1998 Ozaki et al. ..... 418/201.3
6,254,362 B1 * 7/2001 Higuchi et al. ..... 417/423.9
2003/0180153 A1 * 9/2003 Yamamoto et al. ..... 417/53
2007/0104587 A1 * 5/2007 Kawamura et al. ..... 417/32

FOREIGN PATENT DOCUMENTS

EP 0 697 523 2/1996
JP 09004579 A 1/1997

OTHER PUBLICATIONS

European Search Report for European Application No. 05 109 115.5 which corresponds to this application.

* cited by examiner

*Primary Examiner*—Devon C Kramer
*Assistant Examiner*—Dnyanesh Kasture
(74) *Attorney, Agent, or Firm*—Quarles & Brady LLP

(57) ABSTRACT

Disclosed is a dry vacuum pump for evacuating a processing chamber in a semiconductor or display manufacturing device, or for evacuating gaseous substance and/or byproducts generated in the process chamber. The dry vacuum pump does not need a partition wall between the roots rotor and the screw rotor. A space is formed at the under sides of the roots rotor and the screw rotor to contain the object substance therein.

9 Claims, 8 Drawing Sheets

COMPOSITE DRY VACUUM PUMP HAVING ROOTS ROTOR AND SCREW ROTOR

CROSS-REFERENCE TO RELATED APPLICATION

This application claims priority to Korean Patent Application Nos. 10-2004-0078422, 10-2004-0078423, and 10-2004-0078431 filed on Oct. 1, 2004.

FIELD OF THE INVENTION

The present invention relates to a composite dry vacuum pump for evacuating a process chamber of a semiconductor manufacturing device, a display manufacturing device and the like, or for discharging a gaseous substance and/or byproducts generated in the process chamber.

BACKGROUND OF THE INVENTION

Generally, a composite dry vacuum pump has been used for evacuating the process chamber of a semiconductor manufacturing device, a display manufacturing device and the like, or for discharging gaseous substances and/or byproducts generated in the process chamber. A roots rotor, a screw rotor or combinations thereof is used in the dry vacuum pump as described above.

Currently, composite dry vacuum pumps include at least one roots rotor, having at least one lobe, and at least one screw rotor so as to keep the process chamber in a perfect vacuum and thereby reduce the power cost requirement. A roots rotor is used in inhaling and compressing the byproduct, including gaseous substances, generated in the process chamber, and a screw rotor is used in evacuating the gaseous substance and byproduct inhaled by the roots rotor to outside the dry vacuum pump. These rotors are operated in a sealed state to keep the process chamber in a vacuum.

In general, a partition wall is provided between a roots rotor end and a screw rotor end so that the byproducts do not hamper the rotor's rotation and can move smoothly from the roots rotor end to the screw rotor end. A representative example of these configurations is disclosed in U.S. Pat. No. 5,549,463, which is assigned entirely to Kashiyama Industry Co., Ltd.

According to this patent, as illustrated in FIG. 7, a dry vacuum pump comprises a pair of roots rotors 102, 103 and a pair of screw rotors 105, 106. The pair of roots rotors 102, 103 and the pair of screw rotors 105, 106 are rotated by a driving motor 104. The driving force generated by the driving motor 104 is transmitted entirely to the pair of roots rotors 102, 103 and the pair of screw rotors 105, 106 via three gears, that is, a drive gear 124, an idle gear 125 and a follower gear 127. A partition wall is provided between the pair of roots rotors 102, 103 and the pair of screw rotors 105, 106 so that the byproducts from the process chamber (not shown) are not transmitted directly to the pair of screw rotors 105, 106. In this conventional dry vacuum pump, shafts 114*a*, 114*b* respectively connected laterally to the middle of the pair of screw rotors 105, 106 penetrates through the partition wall 108, and the penetrated portions of the shafts are surrounded by a plurality of bearings 110*a*, 110*b* for smooth rotation of each shaft 114*a*, 114*b*. The opposing portions of each shaft 114*a*, 114*b* also are surrounded by a plurality of bearings 112*a*, 112*b* for the same reason. The entire disclosure of this patent is hereby incorporated by reference into the present application.

In the dry vacuum pump 100 disclosed in U.S. Pat. No. 5,549,463, since the partition wall 108 is formed between the pair of roots rotors 102, 103 and the pair of screw rotors 105, 106, the housing for these elements is divided into several portions, which requires increased effort and cost in manufacturing the pump.

A dry vacuum pump using a screw rotor in which a screw with a changeable pitch is used without a partition wall in order to lower power consumption and increase the volume of the byproducts which are to be compressed and evacuated, requires a larger rotor and pump housing than those pumps having a partition wall, which decreases efficiency.

In addition, in a dry vacuum pump as disclosed in the '463 patent, because bearings 110*a*, 110*b* supporting the pair of roots rotors 102, 103 and the pair of screw rotors 105, 106 are disposed at the intake side which changes between a vacuum and ambient pressure repeatedly during operation, grease for lubricating the bearings 110*a*, 110*b* can be leaked from the bearings 110*a*, 110*b* due to the pressure difference, which can cause trouble in the pump. Also, in a dry vacuum pump as disclosed in the '462 patent, because the bearings 110*a*, 110*b* are disposed on the intake side, the high temperature, pressure difference, friction and the like, can shorten the lives of the bearings 110*a*, 110*b*.

Conventional dry vacuum pumps can comprise 4-5 roots rotors for lowering power consumption in operation, that is, for compressing more strongly the byproducts in gas state. The flow of the byproducts through the roots rotors is illustrated in FIG. 8. Even though a partition wall between the roots rotors is not illustrated in FIG. 8, it must be understood that a partition wall is formed between them in practice. However, because such conventional dry vacuum pumps using the aforementioned 4-5 roots rotors indispensably comprises rotor housings, paired rotors, partition walls, and the like, the assembly process is more difficult and complex. In addition, because the internal channels used to inhale and evacuate the byproducts are too long and complicated, gas leakage and internal accumulation of the byproducts is increased.

SUMMARY OF INVENTION

Accordingly, it is the first object of the present invention to provide an improved dry vacuum pump in which it is possible to reduce the power requirement and increase the volume of the byproducts generated in the process chamber to be compressed and evacuated without using a partition wall between a roots rotor end and a screw rotor end of the pump.

In addition, it is the second object of the present invention to provide an improved dry vacuum pump in which it is possible to lower the power consumption and increase the volume of the byproducts to be compressed and evacuated fewer roots rotors.

In addition, it is the third object of the present invention to provide an improved dry vacuum in which it is possible to protect the dry pump's obstacle and life by changing the disposition of the bearings.

To achieve the first object, a dry vacuum pump according to the first aspect of the present invention comprises: (a) a cylindrical housing formed with the intake on one side for inhaling the object substance and with the outlet on opposing side for evacuating the object substance; (b) a roots rotor embedded within the housing in communication with the intake; (c) a screw rotor embedded within the housing and disposed closely to the roots rotor; (d) a shaft fixed through the middle between the roots rotor and the screw rotor, and fixed rotatively to the housing in a sealed state from the exterior; and, (e) a driving motor installed outside the housing, to drive the roots rotor and the screw rotor for rotation in connection with the shaft, wherein, a space is formed at an underside of the roots rotor in communication with an underside of the screw rotor for holding the object substance.

To achieve the second object of the present invention, a dry vacuum pump according to the second aspect of the present invention comprises: (a) a cylindrical housing formed with the intake on one side for inhaling the object substance and with the outlet on an opposing side for evacuating the object substance; (b) roots rotors embedded within the housing, at least one embedded roots rotor being in communication with the intake; (c) a screw rotor embedded within the housing and disposed closely to at least one of the roots rotors; (d) a shaft fixed through the middle between the roots rotors and the screw rotor, and fixed rotatively to the housing in a sealed state from the exterior; and (e) a driving motor installed outside the housing to drive the roots rotors and the screw rotor for rotation in connection with the shaft, wherein a space is formed underneath one of the roots rotors for holding the object substance, the space being in communication with the undersides of the other roots rotors and the screw rotor, and further the space being in communication with an upper side of that roots rotor through a predetermined fluid channel.

To achieve the third object, a dry vacuum pump according to the third aspect of the present invention comprises: (a) a cylindrical housing formed with the intake on one side for inhaling the object substance and with the outlet on an opposing side for evacuating the object substance; (b) a roots rotor embedded within the housing in communication with the intake; (c) a screw rotor embedded within the housing and disposed closely to the roots rotor; (d) a shaft fixed through the middle between the roots rotor and the screw rotor, and fixed rotatively to the housing in a sealed state from the exterior; (e) a driving motor installed outside the housing to drive the roots rotor and the screw rotor for rotation in connection with the shaft; (f) a rotation member to fix rotatively one end of the shaft which is connected to the roots rotor to one end of the housing; and (g) a bearing mechanism fitted on the shaft, and disposed on the outlet and the opposing end of the housing to smooth the rotation of the shaft.

The term "object substance" used in the present description and claims is to be understood to include gaseous substances and/or byproducts generated in the process chambers of a semiconductor manufacturing device, a display manufacturing device and the like.

In addition, the terms "the first" and "the second" in the expression of "the first roots rotor", "the second roots rotor", "the first sump", and "the second sump" is to be understood to mean the sequences in which the object substance follows. The term "front end side", unless described otherwise, is to be understood to refer to the intake side for inhaling the object substance, instead of the outlet side for evacuating the compressed object substance. The term "rear end side" also is to be understood to refer to the outlet side instead of the intake side.

BRIEF DESCRIPTION OF THE DRAWINGS

The accompanying drawings, which are included to aid in understanding the invention and are incorporated into and constitute a part of this application, illustrate embodiment(s) of the invention and together with the description serve to explain the principles of the invention. In the drawings.

DETAILED DESCRIPTION OF INVENTION

Figure 1:
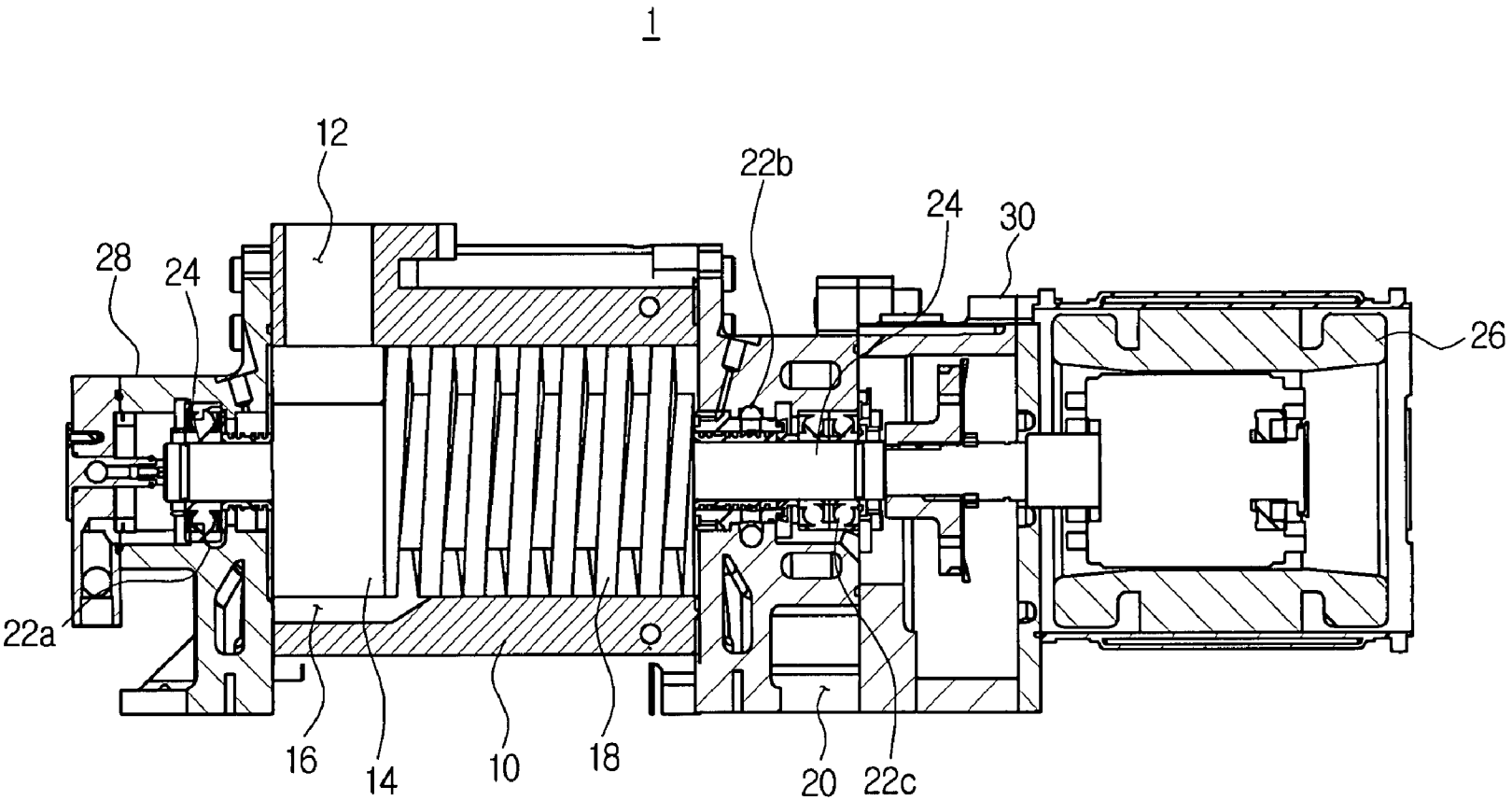
FIG. 1 is a schematic sectional view showing main parts of a dry vacuum pump according to the first aspect of present invention.

The following embodiments are given for the purpose of illustration only and are not intended to limit the scope of this invention.

Hereinafter, the preferred embodiments according to the present invention will be described with reference to the accompanying drawings. Here, when one element is connected to another element, one element may be not only directly connected to another element but also indirectly connected to another element via another element. Further, irrelevant elements are omitted for clarity. Also, like reference numerals refer to like elements throughout.

FIG. 1 is a sectional view showing main parts of a dry vacuum pump according to the first aspect of present invention.

Referring to FIG. 1, a dry vacuum pump 1 according to the first aspect of the present invention comprises a roots rotor 14 at a front end side, a driving motor 26, preferably a water-cooled driving motor, at a rear end side, and a screw rotor 18 between the roots rotor 14 and the driving motor 26. The screw rotor 18 is coaxially connected to the roots rotor 14 with the aid of a shaft 24. In one alternative embodiment, the screw rotor 18 can be coaxially connected to the roots rotor 14 without the aid of a shaft 24. In another alternative embodiment, the roots rotor 14 and the screw rotor 18 are manufactured integrally or assembled by welding after manufacturing them individually. Other alternative connecting methods other than the aforementioned will be considered by a person having ordinary skill in the same art.

Figure 3:
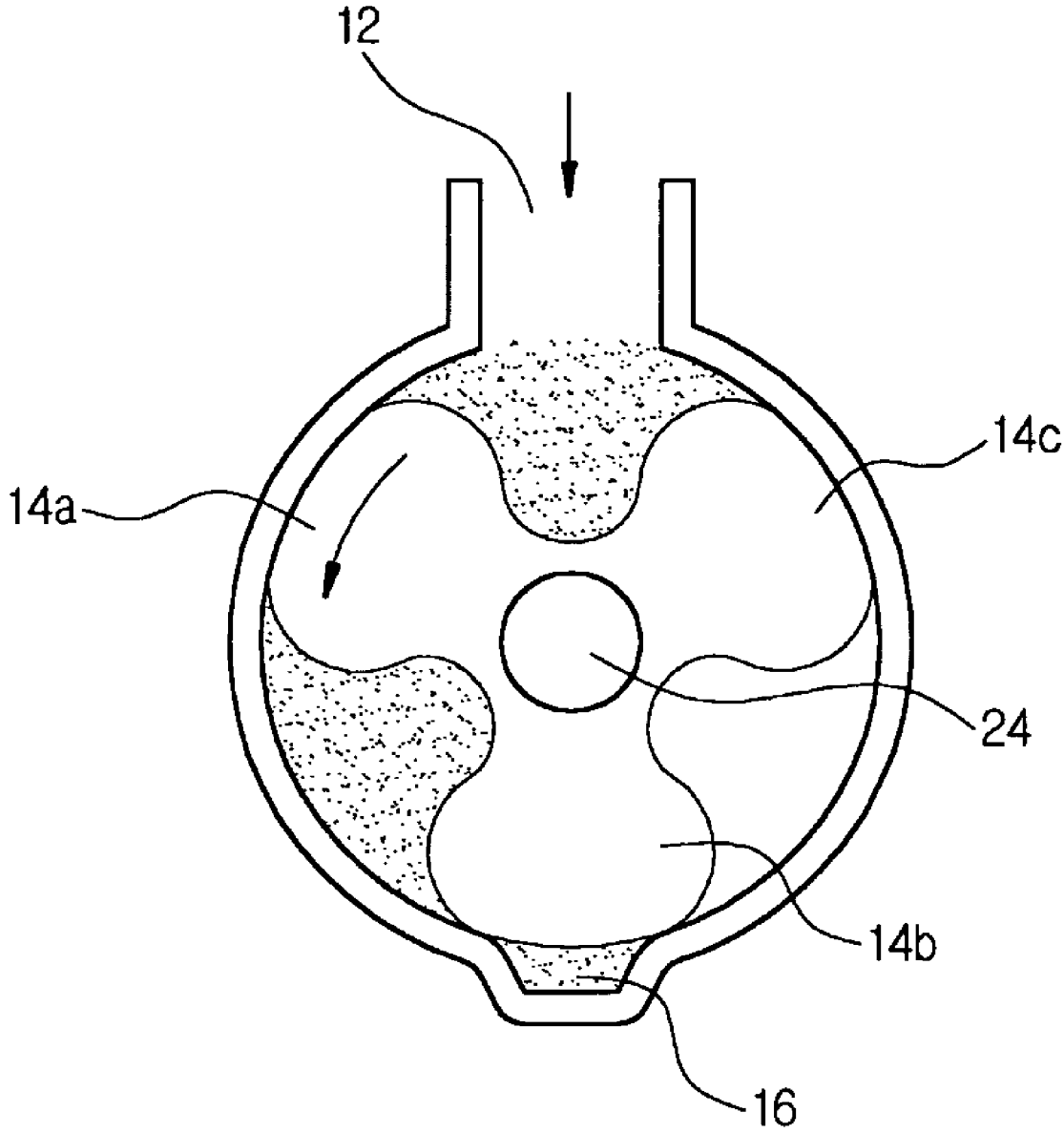
FIG. 3 is a view showing roots rotor's operation principle used in the present invention.

The roots rotor 14 and the screw rotor 18 are installed within a cylindrical housing 10. In the housing 10, the intake 12 to inhale object substance into the vacuum pump 1 is located at an upper side of the roots rotor 14 in the drawings. Because this intake 12 acts to inhale the object substance within the process chamber (not shown) of semiconductor or display manufacturing devices into the vacuum pump 1, it is directly connected to the process chamber in sealed state. The cylindrical housing 10, including the intake 12, is connected to the process chamber of a semiconductor or display device in a sealed state and is protected in a sealed state so that exterior substances do not to enter into the housing. Also, the portion penetrated by the shaft 24 is protected in a sealed state from outside the pump. As shown in FIG. 3, the object substance inhaled through the intake 12 is trapped between lobes 14*a*, 14*b* of the roots rotor 14, and by rotation of the roots rotor 14, it is moved toward the opposing side of the intake 12.

After the object substance is inhaled into the vacuum pump 1 by rotation of the roots rotor 14, it is held temporally within the space 16 (hereinafter called "powder sump") formed at an underside of the roots rotor 14 and a portion of the underside of the screw rotor 18, and is directed toward the screw rotor 18 from the pressure applied by the roots rotor 14. The powder sump 16, as illustrated in the drawing, occupies most of the space at the underside of roots rotor 14 and a part of the space at the underside of the screw motor 18. The spaces formed at the underside of the roots rotor 14 and the underside of the screw rotor 18 are in communication and thus form one powder sump 16. This powder sump 16 can eliminate the need for a partition wall which has been used for lowering power consumption and increasing the volume of the object substance, particularly the object substance to be compressed and evacuated in gas state in conventional dry vacuum pumps. In addition, the powder sump 16 can keep the foreign solid substances within the space, which could otherwise lead to damage of the screw rotor 18.

The object substance entered by force into the screw rotor 18 via the powder sump 16 is compressed and evacuated through an outlet 20 formed at the rear end side of the vacuum pump 1 by the rotation of the screw rotor 18 in one direction and the pressure transmitted from the prior step.

The shaft 24 mounted through the cylindrical housing 10 is supported on the front side wall 28 and the rear side wall 30, respectively, of the vacuum pump with aid of bearings 22*a*, 22*b*, 22*c* disposed as illustrated in FIG. 1. The right side of the shaft 24 is connected to and rotated by the driving motor 26, which can be a water-cooled motor.

Figure 2:
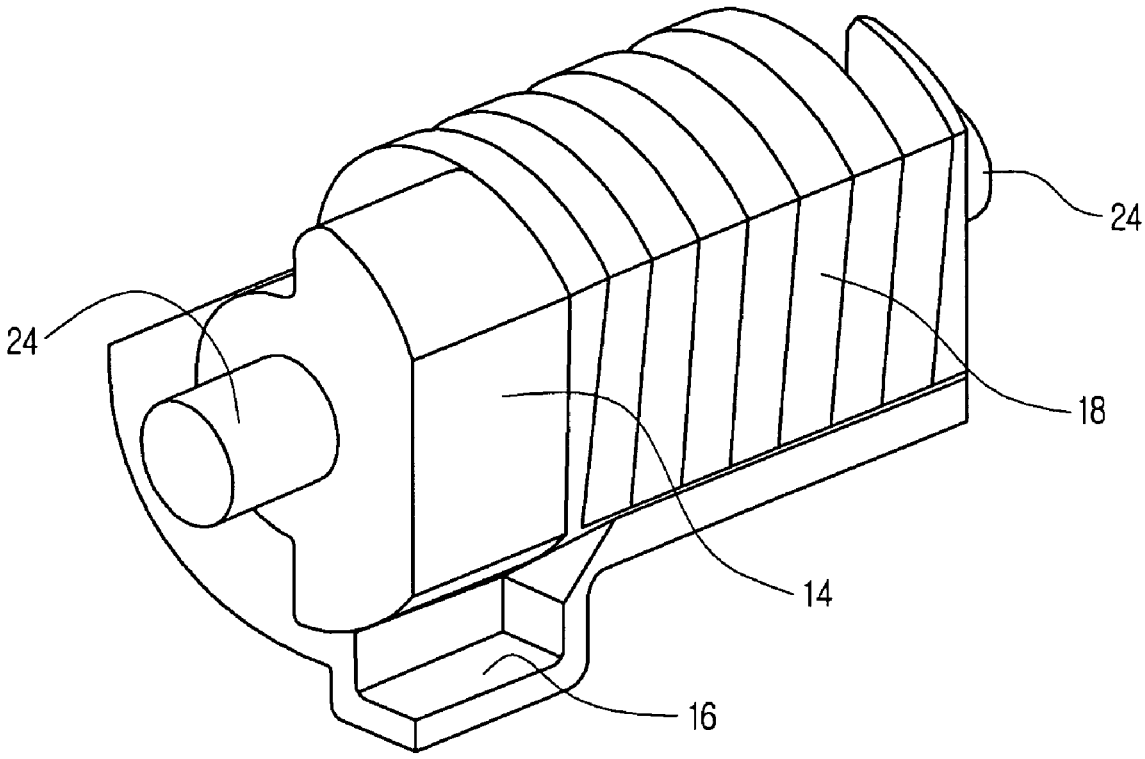
FIG. 2 is a partial view showing the internal parts in the dry vacuum pump of FIG. 1.

As shown in FIG. 2, in the dry vacuum pump 1 according to the first aspect of the present invention, the powder sump 16 is formed commonly at the underside of the roots rotor 14 and a portion of the underside of the screw rotor 18, and acts to contain the object substance, which is transmitted to the underside of the roots rotor 14 by the driving of the roots rotor 14, and keep it therein temporally until it is directed toward the screw rotor 18. Therefore, a partition wall is not required, as it is in conventional dry vacuum pumps. Although the illustrated screw rotor 18 has a consistent pitch from end to end, to increase the compression rate of the gaseous substances and/or the byproducts, the screw rotor 18 could have a different pitch from end to end, that is, it could get incrementally shorter from the intake 12 to the outlet 20.

Referring to FIG. 3, the object substance which is inhaled into the dry vacuum pump 1 is trapped between lobes 14*a*, 14*b*, 14*c* by the rotation of the roots rotor 14 (as illustrated) and conveyed to a predetermined open space or a following process space. In the present invention, the object substance is conveyed to the powder sump 16 formed commonly on an underside of the roots rotor 14 and a portion of the underside of the screw rotor 18, and then directed to the screw rotor 18 through the powder sump 16. The operation principle of the roots rotor itself is well known to the person having ordinary skill in the same art.

Figure 4:
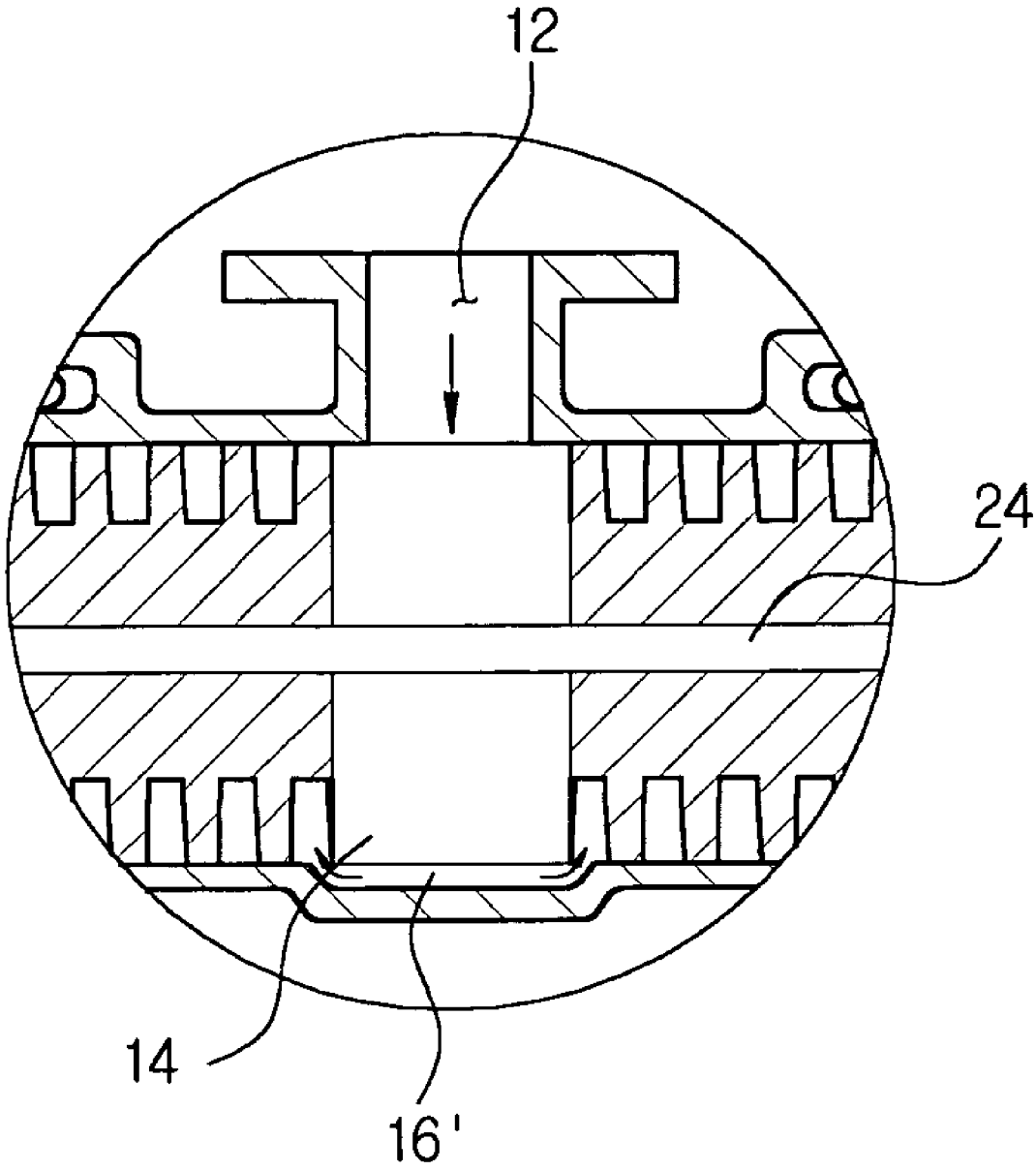
FIG. 4 is a view showing an alternative example in a dry vacuum pump according to the first aspect of the present invention wherein on both sides of the roots rotor, installed on the intake, a screw rotor is coaxially connected to the roots rotor.

In an alternative embodiment shown in FIG. 4, which is similar to the aforementioned embodiment in that the object substance and/or the byproducts in gas state are trapped in the space or spaces between the lobes of the roots rotor 14 and conveyed to the powder sump 16' the screw rotor is installed on both sides of the roots rotor 14, and the powder sump 16' is communicated with a portion of the screw rotor and thereby the object substance in gas state and/or the byproducts are directed in opposing directions. In this alternative embodiment, because the object substance in gas state and/or the byproducts are directed toward the screw rotor installed on both sides of the roots rotor 14, that is, in opposing directions, the outlets (not illustrated) are formed on both sides. In addition, the rotation of the screw rotor installed on both sides of the roots rotor 14 is performed by one shaft 24, and the conveyance direction of the byproducts is dependent on the outlet's position. That is, the screw rotor illustrated on the right side in the drawing is installed to direct the byproducts rightward and the screw rotor illustrated on the left side in the drawing is installed to direct the byproducts leftward. Other alternative parts or elements required by this alternation in configuration can be understood easily by the person having ordinary skill in the same art.

Since the dry vacuum pump 1 according to the first aspect of the present invention does not include a partition wall between the roots rotor 14 and the screw rotor 18, there is no associated increase in the number of elements as there would be if the housing was partitioned and also there is no resulting damage to the screw rotor.

Figure 5:
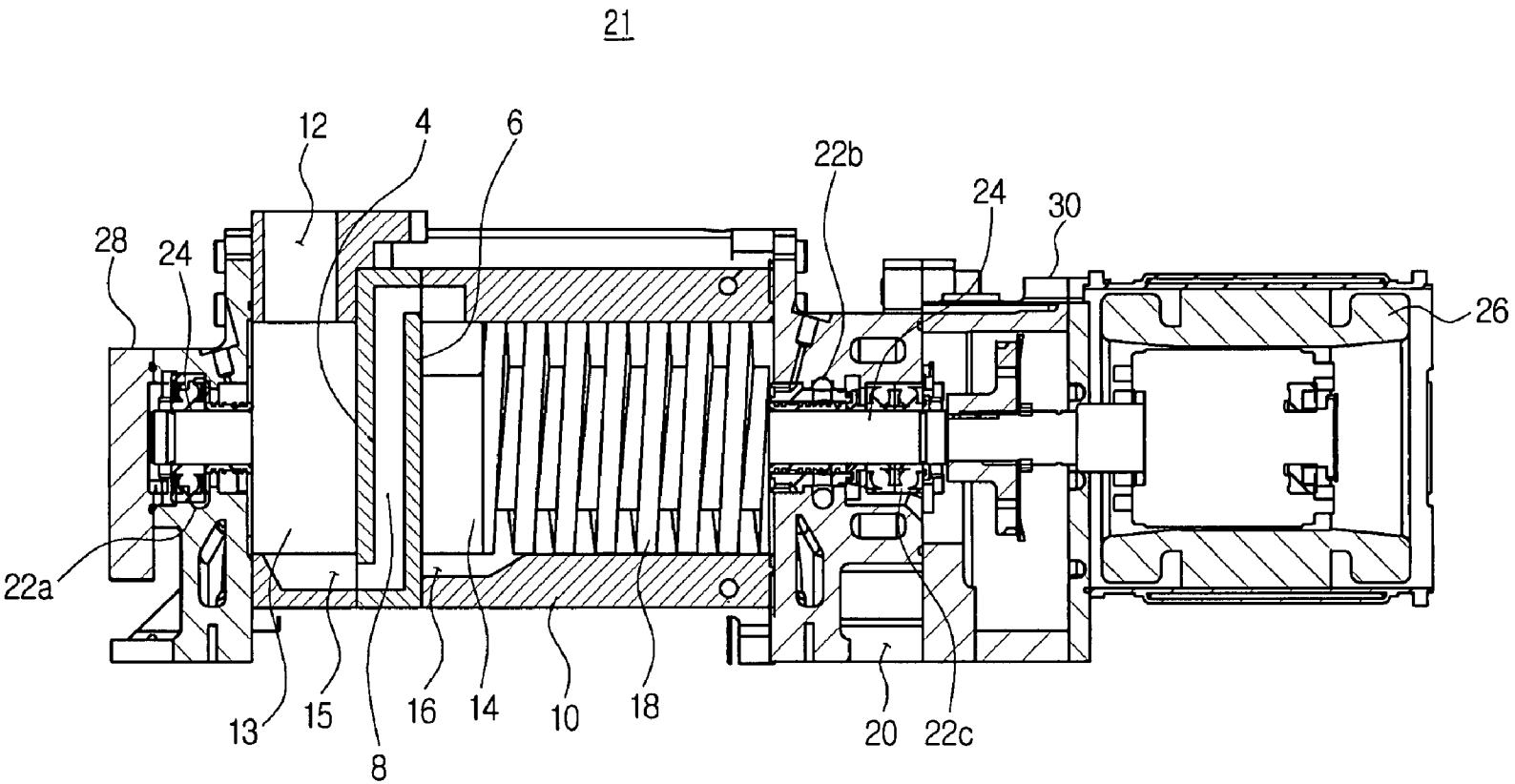
FIG. 5 is a sectional view showing main parts of a dry vacuum pump according to the second aspect of present invention.

In FIG. 5, the main parts of a dry vacuum pump 21 according to the second aspect of present invention is are illustrated. The dry vacuum pump 21 according to the second aspect of the present invention is similar to the dry vacuum pump 1 according to the first aspect of the present invention in most parts, but it is different in that at least two powder sumps 15, 16 are formed and a fluid channel 8 is formed between a first roots rotor 13 and the second roots rotor 14, as illustrated in FIG. 5. The differences in configuration of the dry vacuum pump 21 according to the second aspect different from that of the dry vacuum pump 1 according to the first aspect will now be described.

Referring to FIG. 5, the first and second roots rotor 13, 14 and the screw rotor 18 are embedded in the housing 10. In the housing 10, the intake 12 for inhaling the object substance into the dry vacuum pump 21 is formed at an upper side of the roots rotor 13 in the drawing. Because the object substance within the process chamber (not illustrated) of the semiconductor or display manufacturing device is to be inhaled to inside the vacuum pump 21 through the intake 12, the intake 12 is directly connected to the process chamber (not illustrated) in a sealed state. The cylindrical housing 10, including the intake 12, is connected to the process chamber of the semiconductor or display manufacturing devices in a sealed state and protected in a sealed state so that exterior substances do not enter into it. Also, the portion penetrated by the shaft 24 is protected in a sealed state from the outside. The object substance inhaled through the intake 12 is trapped between lobes (see e.g., alternative lobes 14*a*, 14*b* of the roots rotor 14 in FIG. 2) of the first roots rotor 13 by the rotation of the first roots rotor 13, and moved toward the opposing side of the intake 12.

After the object substance inhaled into the vacuum pump 4-21 with the aid of the first roots rotor 13 arrives at the predetermined space 15 (hereinafter called "first powder sump") by the rotation of the roots rotor 13 and is contained temporally therein, it is conveyed to the upper side of the second roots rotor 14 via the fluid channel defined by the partition wall 4, which opens to the underside and the partition wall 6, which opens to the upper side. This fluid channel 8 can substituted by a plurality of, for example 4-5, roots rotor rotors and partition walls therebetween which have been used in conventional dry vacuum pumps.

As the object substance conveyed to the upper side of the second roots rotor 14 is trapped between the lobes 14*a*, 14*b* formed on the second roots rotor 14 by the rotation of the second roots rotor 14, and conveyed to the opposing side of the intake 12 (refer to FIG. 5 together with FIG. 2), the object substance is conveyed to the predetermined space 16 (Hereinafter called "second powder sump") formed commonly on the under sides of the second roots rotor 14 and the screw rotor 18, and then directed toward the screw rotor 18 with pressure applied by the second roots rotor 14. The second powder sump 16 occupies most of the space at the underside of the second roots rotor 14 and a part of the space at the underside of screw motor 18. The powder sump 16 formed on the undersides of the second roots rotor 14 and the screw rotor 18 is in fluid communication and thus effectively forms one space.

The object substance entered by force into the screw rotor 18 via the second powder sump 16 is compressed and evacuated through the outlet 20 formed on the rear end side of the vacuum pump 21 by the rotation of the screw rotor 18 in one direction and the pressure transmitted from the prior step.

The shaft 24 installed through the cylindrical housing 10 is supported on the front side wall 28 and the rear side wall 30, respectively, of the vacuum pump with the aid of bearing mechanisms 22*a*, 22*b*, 22*c*. The shaft 24 illustrated on the right side in the drawing is connected to the driving motor 26, which can be a water-cooled motor 26, and is rotated by the motor's operation.

Whether it is the object substance which is inhaled into the inside of the dry vacuum pump 21 through the intake 12, or it is the object substance which is conveyed to the second roots rotor 14 with the aid of the first roots rotor 13, it is trapped between the lobes 14*a*, 14*b*, 14*c* by the rotation of the first or second roots rotor 13 or 14, and conveyed to the predetermined space or the space of a following step.

Figure 6:
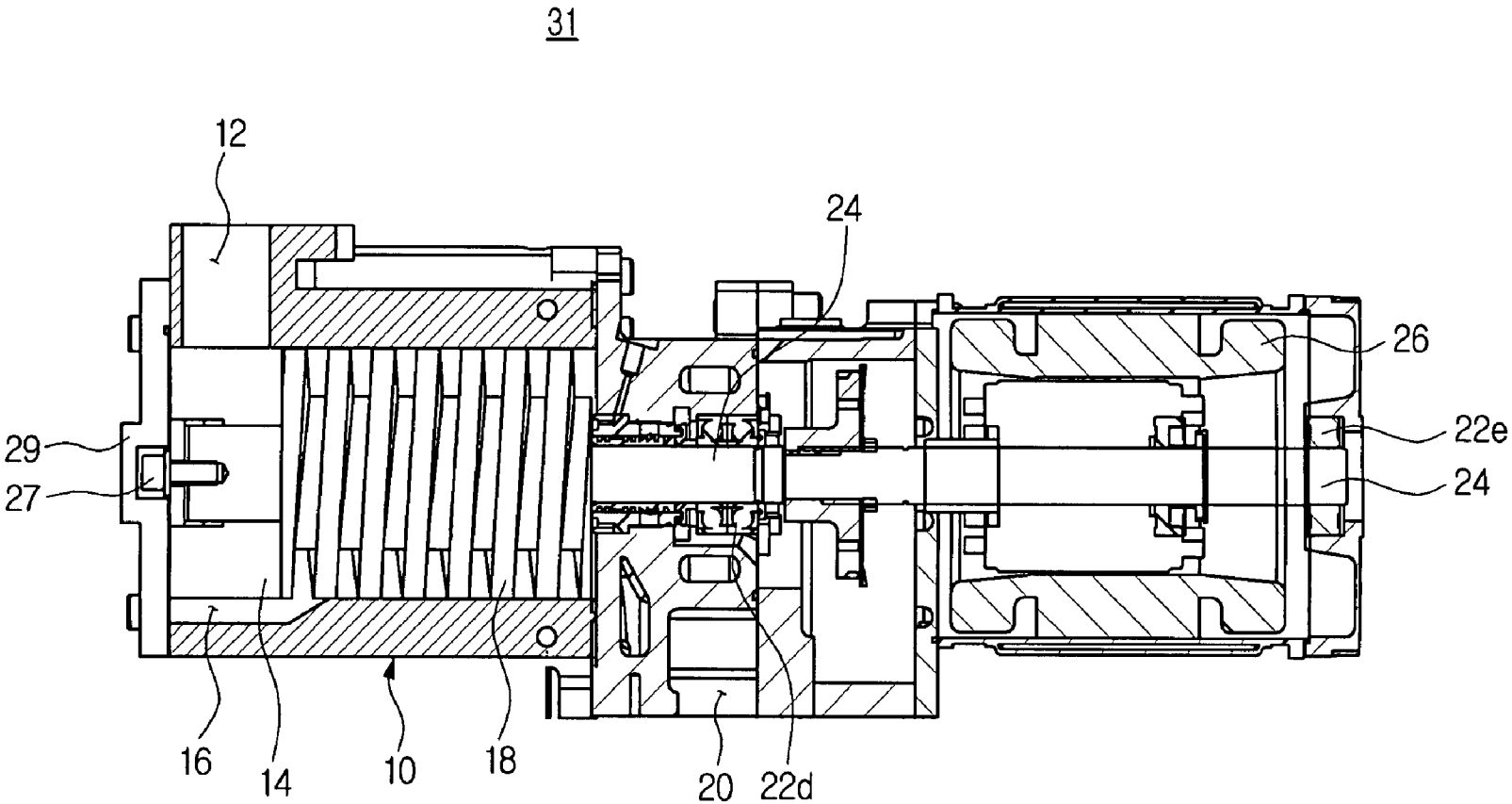
FIG. 6 is a sectional view showing a dry vacuum pump according to the third aspect of present invention.
Figure 7:
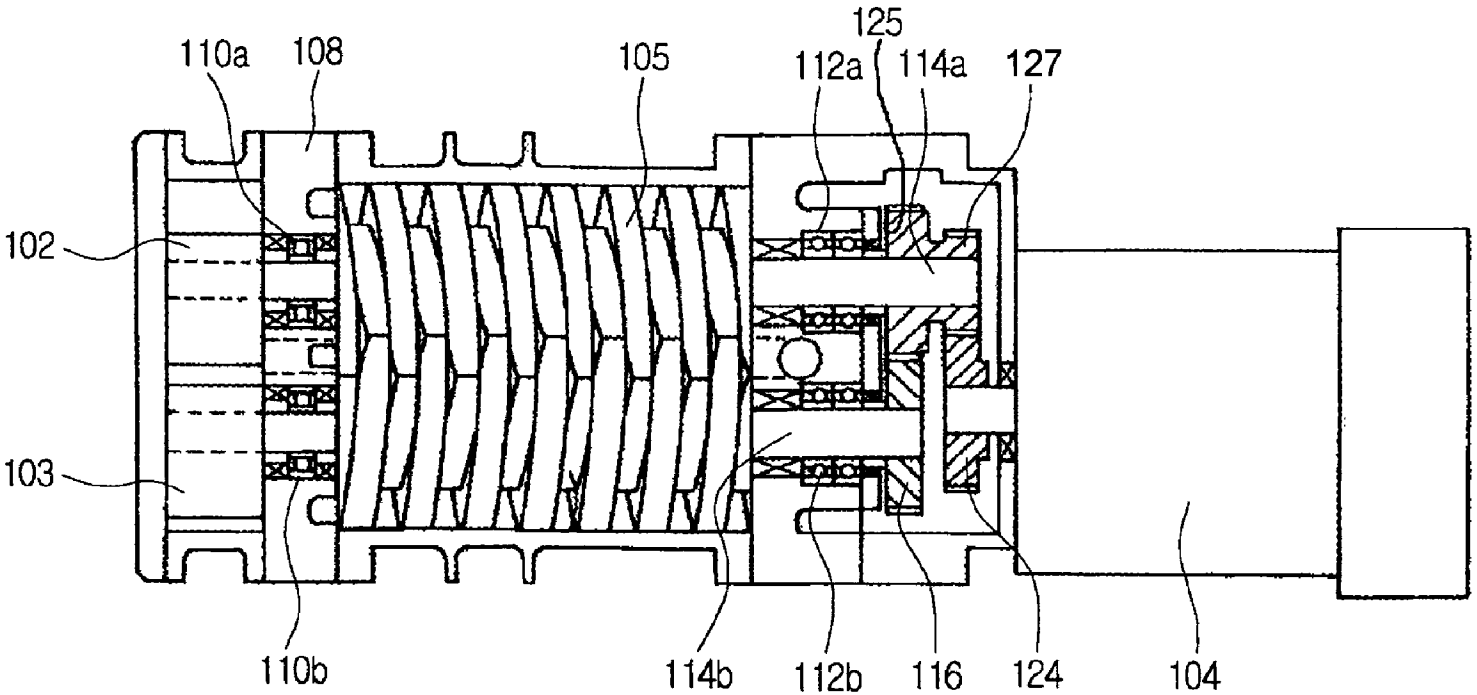
Fig. 7 (Prior Art)
FIG. 7 is a sectional view showing a conventional dry vacuum pump.
Figure 8:
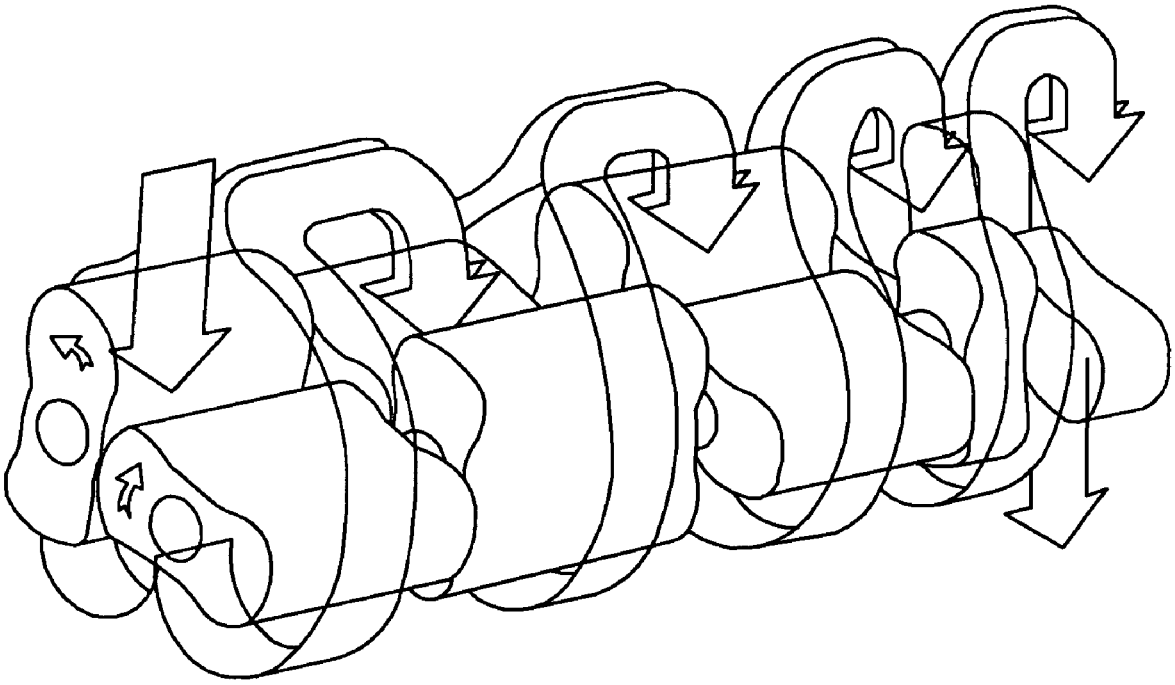
Fig. 8 (Prior Art)
FIG. 8 is a view showing roots rotor's operation used in a conventional dry vacuum pump in which multiple roots rotors are included in one dry vacuum pump.

In FIG. 6, the sectional parts of the dry vacuum pump according to the third aspect of present invention are illustrated. The dry vacuum pump according to the third aspect of the present invention is almost the same as the dry vacuum pump according to the first and second aspects of the present invention except with regard to the disposition of the bearing mechanism. The differences in configuration of the dry vacuum pump according to the third aspect different from that of the dry vacuum pump according to the first and second aspects will now be described.

Referring to FIG. 6, the dry vacuum pump 31 according to the third aspect of the present invention, in addition to individual or common elements which are included in the dry vacuum pump according to the first and second aspects of the present invention, further comprises a rotation member 27 for fixing rotatively one end of the shaft 24 connecting the roots rotor 14 to one end of the housing 10, and the bearing mechanisms 22*d*, 22*e* which are fitted on the shaft 24 and disposed on the outlet side 20 and the opposing end side of the housing 10 to support the shaft 24 and smooth the rotation of the shaft 24.

The shaft 24 is installed through the housing 10 as described above. One end of the shaft 24 is rotatively mounted to the housing 10 via and the bearing mechanism 22*d*, 22*e* to support the middle and opposite end of the shaft 24, respectively. More specifically, the rotation member 27 acts to fix rotatively one end of the shaft 24 which is disposed on the intake side of the housing via a pin or bolts. A finish wall 29 is also formed on one end of the housing 10 to which the rotation member 27 is fixed. The finish wall 29 acts to prevent the separation of the pin member 27 and support the shaft 24 more safely in the event that the shaft 24 is fixed rotatively to the housing by using a pin member.

The plural bearings 22*d*, 22*e* are disposed on the shaft 24 to support the shaft 24 and smooth the rotation of the shaft 24. The first bearing mechanism 22*d* surrounds the part of the shaft 24 disposed on an end of the screw rotor 18 running to the outlet 20 of the housing 10, and helps the rotation of the shaft 24. The second bearing mechanism 22*e* is disposed on one end of the shaft 24 connected to the driving motor 26, and helps the rotation of the shaft 24. The second bearing mechanism 22*e* is disposed on one end of the housing 10 to prevent obstacles from the second bearing 22*e* disposed on the shaft 24 running to the intake 12 of the housing 10.

A partition wall (not illustrated) may be also formed between the screw rotor 18 and the roots rotor 14. In the case where a partition wall (not illustrated) is used, the partition wall (not illustrated) is formed to support the residual part of the screw rotor 18 and roots rotor 14 excluding the shaft 24.

In addition, in the dry vacuum pump according to the third aspect of the present invention, for staying the object substance, the space 16 ("powder sump") is formed on the portion connected to the roots rotor 14. The powder sump 16 functions as same as the dry vacuum pump according to the first and second aspect of the present invention.

In the configuration as described above, the bearing on the intake side of the housing can be omitted, which makes the configuration more simple and production easier, and thereby increase production efficiency and lengthens the bearing life.

Although the dry vacuum pump is described herein referring to the preferred embodiment according to each aspect of the present invention, it will be apparent to those skilled in the art that various modifications and variations can be made in the present invention. Thus, it is intended that the present invention covers the modifications and variations of this invention provided they come within the scope of the appended claims and their equivalents.

What is claimed is:

1. A composite dry vacuum pump comprising:

a cylindrical housing formed with an intake on one side for inhaling an object substance and with an outlet on an opposing side for evacuating the object substance;

a roots rotor embedded within the housing in communication with said intake;

a screw rotor embedded within the housing and disposed proximate to the roots rotor, wherein said roots rotor and said screw rotor are mounted on a common shaft, wherein said shaft is rotatably mounted in the housing and sealed from the outside of the housing; and a driving motor mounted outside of the housing to rotate said roots rotor and said screw rotor via said shaft, wherein the housing defines a sump that temporarily contains said object substance, wherein said sump is disposed at an underside of said roots rotor and extends to at least a portion of an underside of said screw rotor, wherein a sump border is defined by the housing downstream of the outlet side of said roots rotor and upstream of the intake side of said screw rotor.

2. The dry vacuum pump according to claim 1, wherein the sump at the underside of said roots rotor is larger than the sump at the underside of said screw rotor.

3. The dry vacuum pump according to claim 1, wherein said driving motor is water-cooled.

4. The dry vacuum pump according to claim 1, wherein a pitch of said screw rotor shortens in the direction from the intake to the outlet.

5. A composite dry vacuum pump comprising:

a cylindrical housing formed with an intake on one side for inhaling an object substance and with the outlet on an opposing side for evacuating the object substance;

at least one roots rotor embedded within the housing in communication with said intake;

a screw rotor embedded within the housing and disposed proximate to the at least one roots rotor, wherein said at least one roots rotor and said screw rotor are mounted on a common shaft, wherein said shaft is rotatably mounted in the housing and sealed from the outside of the housing; and;

a driving motor mounted outside of the housing to rotate said roots rotor and said screw rotor via said shaft;

wherein the housing defines a sump that temporarily contains said object substance, wherein said sump is disposed at an underside of said at least one roots rotor and extends to at least a portion of an underside of said screw rotor, wherein the sump at the underside of said at least one roots rotor is in communication with an upper side of said at least one roots rotor via an internal fluid channel, and wherein a sump border is defined by the housing downstream of the outlet side of said at least one roots rotor and upstream of the intake side of said screw rotor.

6. The dry vacuum pump according to claim 5, wherein the sump at the underside of said roots rotor is larger than the sump at the underside of said screw rotor.

7. The dry vacuum pump according to claim 5, wherein said driving motor is water-cooled.

8. The dry vacuum pump according to claim 5, wherein a pitch of said screw rotor shortens in the direction from the intake to the outlet.

9. A composite dry vacuum pump comprising:

a cylindrical housing formed with an intake on one side for inhaling an object substance and with an outlet on an opposing side for evacuating the object substance;

a roots rotor embedded within the housing in communication with said intake;

a screw rotor embedded within the housing and disposed proximate to the roots rotor;

wherein said roots rotor and said screw rotor are mounted on a common shaft, wherein said shaft is rotatably mounted in the housing and sealed from the outside of the housing; and;

a driving motor mounted outside of the housing to rotate said roots rotor and said screw rotor via said shaft;

a rotation member for rotatively mounting one end of the shaft to one end of the housing;

a bearing mechanism fitted on said shaft and for rotatively mounting said shaft to an opposite end of the housing; and wherein the housing defines a sump that temporarily contains said object substance, wherein said sump is disposed at an underside of said roots rotor and extends to at least a portion of an underside of said screw rotor, wherein a sump border is defined by the housing downstream of the outlet side of said roots rotor and upstream of the intake side of said screw rotor.

* * * * *